United States Patent [19]

Arevalo

[11] 4,037,557

[45] July 26, 1977

[54] HAND-DRIVEN WATER CRAFT

[76] Inventor: Luis Jorge Velandia Arevalo, Torres Los Andes, Apt. No. 6, Merida, Venezuela

[21] Appl. No.: 611,429

[22] Filed: Sept. 8, 1975

Related U.S. Application Data

[63] Continuation-in-part of Ser. No. 403,713, Oct. 4, 1973, Pat. No. 3,903,834.

[51] Int. Cl.[2] ..... B63H 16/04

[52] U.S. Cl. ..... 115/24

[58] Field of Search ..... 115/21–24, 115/24.3, 26.1; 114/121–126

[56] References Cited

U.S. PATENT DOCUMENTS

| | | | |
|---|---|---|---|
| 833,608 | 10/1906 | Le Blanc | 115/22.3 |
| 1,005,478 | 10/1911 | Sandberg | 115/22.3 |
| 1,030,525 | 6/1912 | Myers | 115/22.3 |
| 1,321,267 | 11/1919 | Wilson | 115/22.1 |
| 1,516,241 | 11/1924 | Osterhout | 115/24 |
| 1,650,497 | 11/1927 | Dayde | 115/26.3 |
| 1,792,407 | 2/1931 | Bafaro | 115/26.3 |

*Primary Examiner*—Trygve M. Blix
*Assistant Examiner*—Jesus D. Sotelo
*Attorney, Agent, or Firm*—Imirie, Smiley & Linn

[57] ABSTRACT

A hand-driven water craft having a narrow main hull portion cooperating with a submerged ballast member for the support of a generally flat deck partially overlying the hull and partially extending rearwardly therefrom as a cantilever, the hull supporting a hand crank propeller assembly for imparting forward propulsion to the craft, and the rear portion of the deck supporting a rudder adapted to be engaged by the feet of an operator lying in a prone position atop the deck.

6 Claims, 10 Drawing Figures

FIG. 7
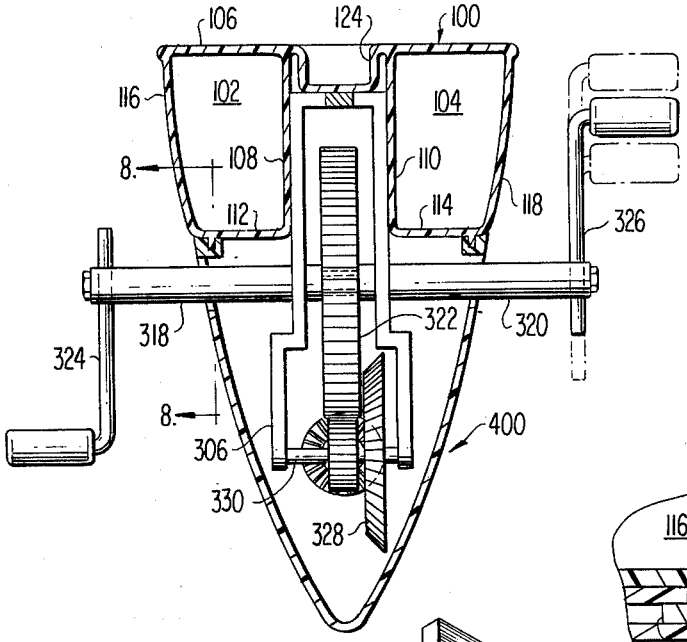
FIG. 8
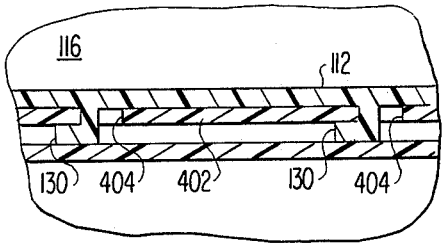
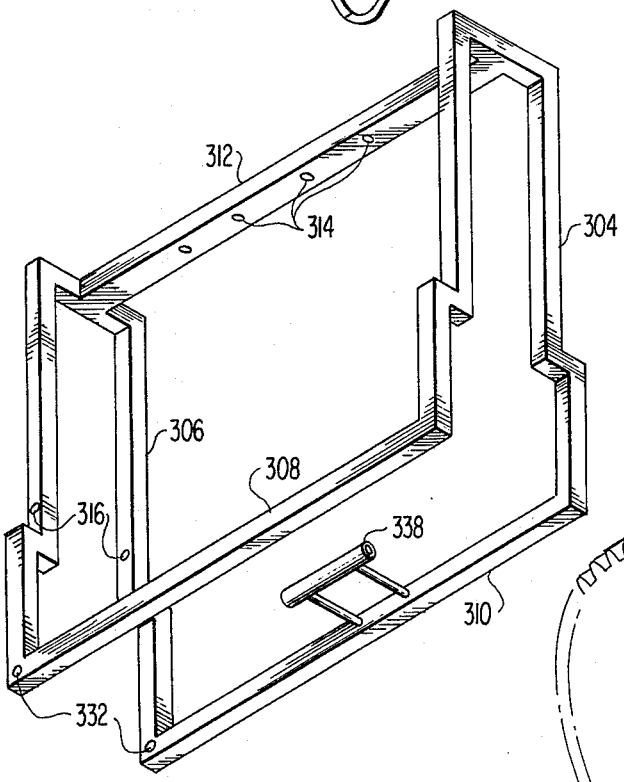
FIG. 9
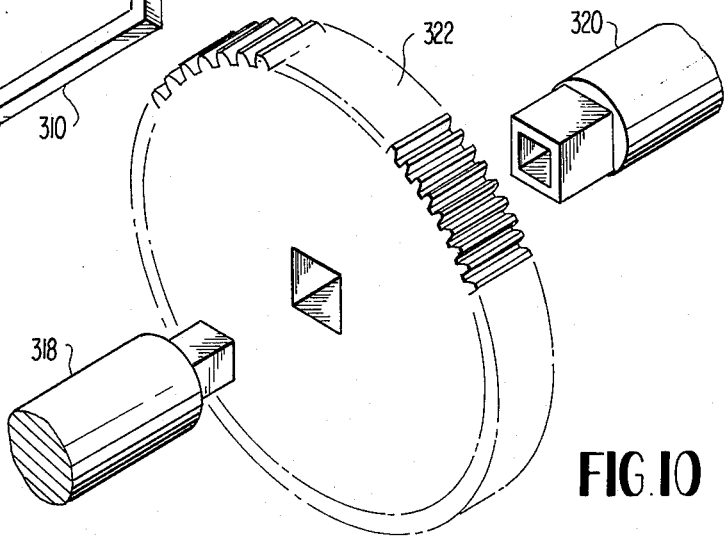
FIG. 10

HAND-DRIVEN WATER CRAFT

CROSS-REFERENCE TO RELATED APPLICATION

This application is a continuation-in-part of application Ser. No. 403,713, filed Oct. 4, 1973, now U.S. Pat. No. 3,903,834, issued Sept. 9, 1975.

BACKGROUND OF THE INVENTION

1. Field of the Invention

The present invention relates to sporting and/or recreational devices, and more particularly to a stable, hand-driven water craft for individual use.

2. Description of the Prior Art

By virtue of recent increases in available leisure time, a need has arisen for various novel devices designed primarily for use in connection with recreational or sports activities. Water sports, for example, continue to be extremely popular, and have stimulated the development of numerous aquatic devices and small water craft for individual use.

Exemplary of such devices are row boats, canoes, surfboards and various portable and/or inflatable rafts, boats, and the like. Typically, such devices are propelled either by natural forces, as in the case of sail boats and surfboards, or by means of an inboard or outboard motor most commonly driven by an internal combustion engine. While such prior art systems have proven to be satisfactory for their intended purpose, a simple, lightweight, extremely stable water craft for individual use, operated by a hand-driven propeller has heretofore been unavailable.

The prior art, as exemplified by U.S. Pat. Nos. 901,862; 1,030,525; 1,321,267; 1,516,241; 2,045,645; and 2,858,788 and Australian Pat. No. 22,953, is generally cognizant of recreational water craft of type to which the present invention pertains. However, these prior devices are typically cumbersome, cannot be easily disassembled for travel or repair, do not exhibit acceptable hydrodynamic characteristics, and are expensive. For these reasons, among others, such prior art craft have not been well received in the market place.

SUMMARY OF THE INVENTION

Accordingly, it is a primary object of the present invention to overcome the shortcomings of the prior art in the construction of a small water craft in the form of a surfboard-like deck overlying a partial hull having the characteristics of extreme stability and maneuverability.

The present invention may be summarized in that a water craft comprises a high-draft hull portion, a deck member overlying the hull portion and extending rearwardly therefrom in cantilever-like manner, the deck supporting an individual in a prone position, a propulsion assembly in the hull portion including a propeller extending rearwardly therefrom and driven by means of a hand crank extending transversely through the hull, and a foot controlled rudder assembly pivotally mounted on the deck.

The craft may comprise a simple one piece assembly or a more sophisticated multi-part, modular structure including float chambers and being adjustable in size for better accommodation of persons of different size and height. Moreover, flotation chambers may be incorporated in the assembly.

The present invention has numerous advantages over the prior art especially in view of its simplicity in design and construction, the capability of the same to be manufactured in lightweight form, the advantage of surfboard-like operation with substantially increased stability provided by the hull structure, the flexibiity of disassembly and ease of repair provided by modular construction, and the ability of an operator to comfortably operate the propulsion assembly with his hands while simultaneously controlling the steering mechanism with his feet.

BRIEF DESCRIPTION OF THE DRAWINGS

FIG. 7 is a cross-sectional view taken on line 7—7 of FIG. 4;

FIG. 8 is an enlarged fragmentary view taken on line 8—8 of FIG. 7;

FIG. 9 is a perspective view of the frame for supporting the propulsion system, and FIG. 10 is an enlarged, fragmentary view of a detail of the propulsion system.

DETAILED DESCRIPTION OF THE PREFERRED EMBODIMENTS

Figure 1:
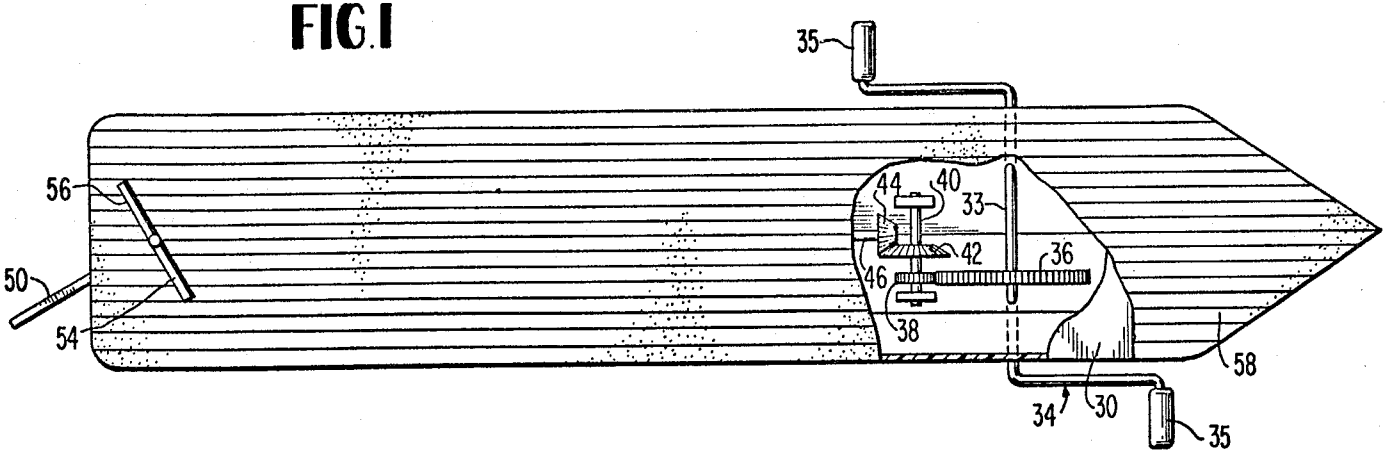
FIG. 1 is a plan view, with parts broken away, of one embodiment of a water craft in accordance with the present invention.
Figure 2:
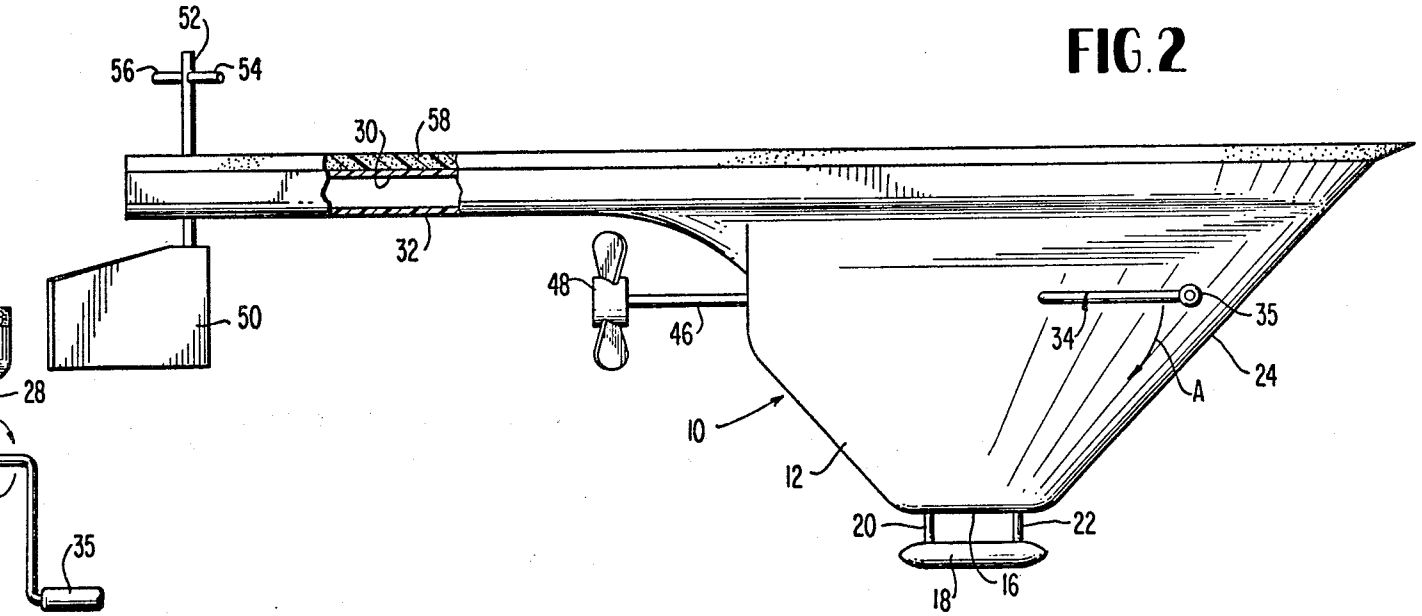
FIG. 2 is a side elevational view of the water craft of FIG. 1.
Figure 3:
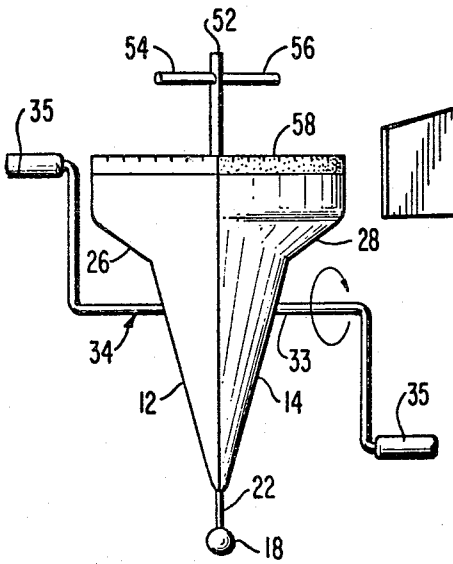
FIG. 3 is a front elevational view of the water craft of FIG. 1.

Referring more specifically to FIGS. 1-3 of the drawing, the present invention comprises a compact unit including a hull portion 10, having first and second generally upright side walls 12 and 14 diverging slightly from their juncture along their lower edges to form an apex 16. A ballast 18, in the form of a tapered, solid bar of suitable heavy material, such as a metal, is connected in spaced relation to apex 16 by a pair of supports 20 and 22. The ballast 18 may be removably mounted to enable substitution of different weights.

The forward edges of each of the side walls 12 and 14 define an angle of approximately 45° with respect to horizontal and are inwardly directed so as to meet along a generally straight line to form the prow 24 of the craft. Likewise, the rear edges of walls 12 and 14 extend from the bottom initially at an angle of approximately 45° and then in a substantially vertical direction and are joined by a flat rear surface. The upper portions of walls 12 and 14 have outwardly offset parts 26 and 28 which extend upwardly in a vertical direction where they are connected to support a flat, elongated deck member 30.

Deck 30 may be molded integrally with the hull 10 or may be constructed separately therefrom and connected by appropriate rivets, adhesives or the like. As best shown in FIGS. 1 and 2, deck 30 extends over the top of the hull 10 and continues rearwardly therefrom in a cantilever-like manner, with the forward portion of the deck tapering to a point conforming with the general shape of the prow of the hull. A generally flat bottom plate 32 (FIG. 2) is attached under the rear portion of deck 30 by suitable short side walls to define a generally rectangular cavity which may be empty or filled with a buoyant material such as foamed plastic.

The craft of the present invention further includes a hand-driven propulsion assembly in the form of a generally Z-shaped hand crank 34 having handles 35 offset from a central shaft 33, extending transversely through side walls 12 and 14 of hull 10. Fixedly secured on the central shaft 33 of crank 34 is a first gear wheel 36. Gear 36 cooperates with a smaller gear wheel 38 which is secured to a shaft 40 journalled for rotation between a pair of upright supports in hull 10.

Also secured to shaft 40 is a bevel gear 42 which cooperates with a smaller bevel gear 44 mounted on the end of a drive shaft 46. Shaft 46 extends through a suitable opening in the rear of hull 10 so as to drive a propeller 48 attached at the end thereof. The propulsion assembly enables the operator of the device to rotate gear 36 by means of the crank 34 whereupon such rotary motion is translated through the illustrated gear train to the propeller 48. Preferably, the ratio of the gear structure is such as to rotate the propeller at a high rate of speed relative to the rotational speed of the hand crank 34.

A flat, generally rectangular rudder 50 is mounted on the lower end of a support bar 52 which is journalled for pivotal movement through bottom plate 32 and deck 30 at the stern of the craft. A pair of pedals 54 and 56 extend from either side of the bar 52 generally perpendicular to the plane of the rudder 50 so as to facilitate rudder control and thus steering of the craft by the feet of an operator. Because the hull 10 is only about 50% of the length of the craft, and because the rudder is mounted at the extreme end of the overhanging deck, the craft is extremely maneuverable. The fact that the propeller is close to the hull 10 and at the same time is spaced from the rudder 50 further enhances maneuverability similar to the control experienced when operating a motor vehicle in reverse.

A suitable cushion 58, of sponge rubber, for example, preferably overlies the entire surface of deck 30 for the comfort of the operator and may be ribbed, as illustrated, or otherwise textured as desired.

It can be appreciated from the above, that the water craft according to the present invention will conveniently and comfortably accommodate an individual operator, in a prone position atop the cushion 58 of the deck 30. In such position, the operator may easily grasp the handles of the crank 34 so as to cause the rotation of propeller 48. At this same time, the operator's feet may be placed in contact with pedals 54 and 56 for controlling the position of rudder 50.

At this point, it is noted that hull 10 is designed to be substantially completely submerged in operation such that the craft in use resembles a surfboard or similar device. By virtue of the complete submersion of the high draft, narrow hull, the craft is extremely stable and is not easily overturned. Further, by virture of the design of the hull 10 along with ballast 18, the side-to-side rocking forces caused by the rotation of crank 34 are materially dampened and have relatively little effect.

The entire hull and deck portion may be molded in a unitary fashion from a suitable material, such as fiberglass, with the accommodating openings for crank 34 and propeller shaft 46 made water-tight so that both the hull and its cantilever deck provide buoyancy for supporting the operator on the surface of the water. Furthermore, in addition to the stabilization and buoyancy factors provided by the hull construction 10, the same may effectively shield or encapsulate the gear drive assembly mechanism of the propeller 48 from exposure to water.

The pitch of the blades of propeller 48 is arranged to propel the craft forwardly when the crank 34 is operated in the direction of the arrow A, FIG. 2. The crank 34 is substantially submerged in the water when the device is in use so that movement of the crank handles 35 and the operators arms function in the manner of a swimmer's stroke to assist in propelling the craft.

Figure 4:
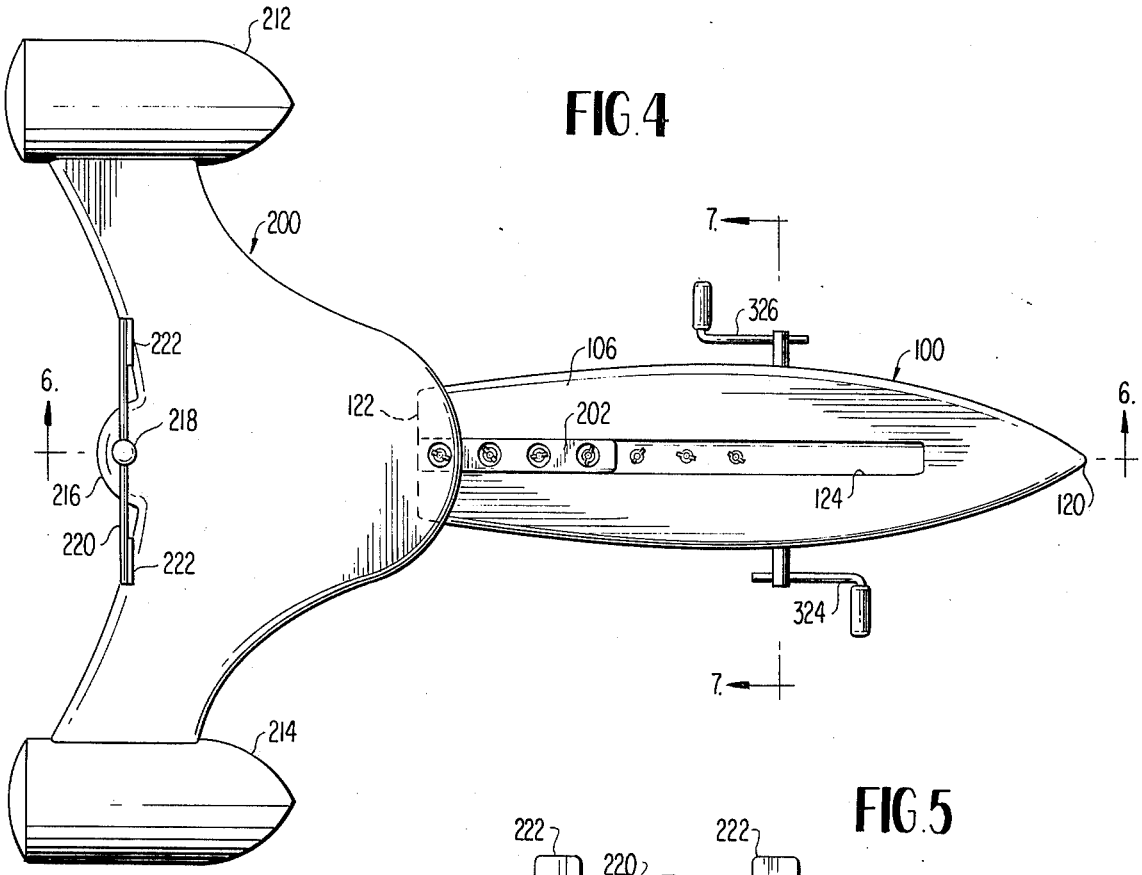
FIG. 4 is a plan view of another water craft - according to the present invention.
Figure 5:
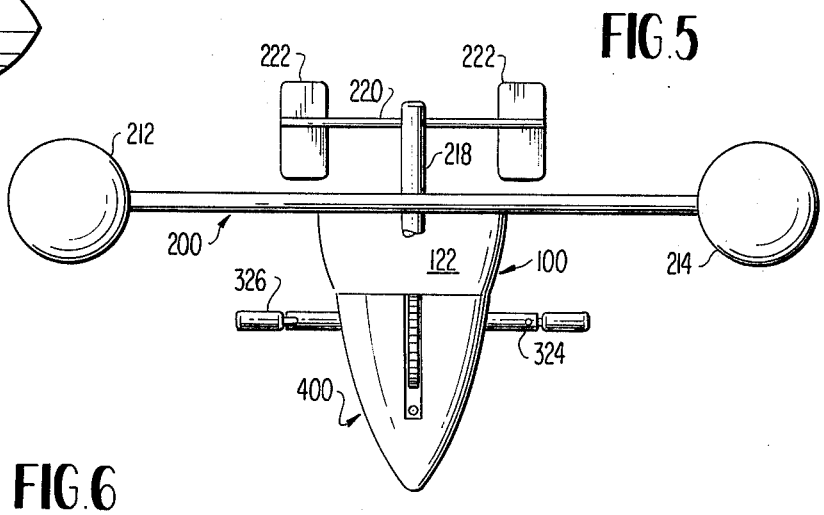
FIG. 5 is a rear elevational view of the craft shown in FIG. 4, the rudder and propeller being omitted.

A second embodiment of the water craft according to the present invention is illustrated in FIGS. 4–10. As shown, the craft includes front and rear separable modular components 100 and 200, respectively, each preferably constructed of molded plastic. Forward section 100 comprises two elongated, sealed float members 102 and 104 (FIG. 7) which are joined together in spaced relationship by a generally flat top wall 106. Chambers 102 and 104 each have flat inside and bottom walls 108–110 and 112–114, respectively. The outside walls 116 and 118 of chambers 102 and 104 are curved as shown in FIG. 4 and extend from an apex at the prow 120, where they are joined together, to a substantially flat, vertical, transverse rear wall 122.

Figure 6:
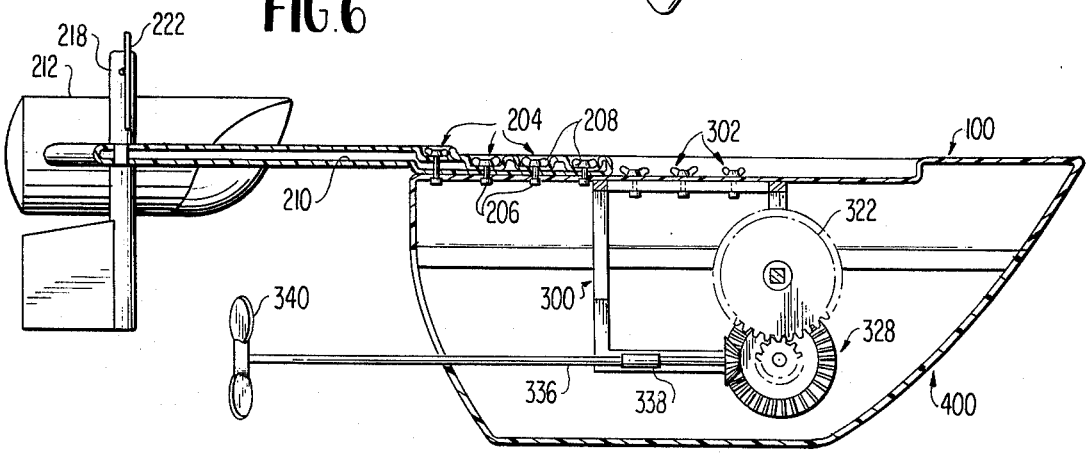
FIG. 6 is a cross-sectional view taken on line 6—6 of FIG. 4.

An elongated generally rectangular channel 124 is formed in the top surface 106 and extends from the back wall 122 forwardly approximately two-thirds of the length of the front portion 100. Channel 124 receives an elongated generally rectangular tongue 202 formed on the front of the rear module section 200. Tongue 202 is received in channel 124 and is securely held therein by a plurality of fasteners which may be of any suitable type such as threaded fasteners 204 (FIG. 6). Fasteners 204 may include bolts 206 attached to the front portion 100 and protruding upwardly from the middle of channel 124 at regularly spaced intervals. Cooperating wing nuts 208 are accommodated within suitable recesses in the upper surface of tongue 202 to hold the two main portions of the craft securely together in any one of a series of adjustable positions to determine the overall length of the craft.

Rear portion 200 is preferably formed of molded plastic in a generally flat, hollow configuration. In plan, the rear portion 200 is somewhat swept-wing in shape having a smoothly curved leading edge resembling a parabola with divergent trailing edges. As best shown in FIG. 6, the flat, main body of rear portion 200 defines a sealed flotation chamber 210 which assists in maintaining buoyancy and stability of the craft in operation. Also, on both outer ends of the wing-like rear portion 200 are flotation pontoons 212 and 214 having a hydrodynamic overall configuration. A generally circular protrusion 216 formed in the rear portion 200 supports an upright rudder assembly 218 having a transverse control arm 220. Arm 220 supports a pair of foot pedals 222 on either side to facilitate steering of the craft by the feet of an operator.

A separate, modular propulsion assembly 300 is attached to front portion 100 of the craft by means of suitable fasteners such as threaded fasteners 302. By removing the wing nuts of threaded fasteners 302, the entire propulsion assembly 300 may be quickly and easily removed for replacement or repair.

As shown in FIG. 9, the propulsion unit 300 has a frame comprising first and second inverted, generally U-shaped members 304 and 306 having the ends of their arms interconnected by a pair of elongated frame members 308 and 310. Another elongated frame member 312 joins the top ends of inverted, U-shaped members 304 and 306. Holes 314 are formed in member 312 and are adapted to receive fasteners 302 for interconnection of the modular propulsion assembly 300 with the remaining modular portions of the craft.

As shown in FIG. 7, the spacing between the arms of each of the U-shaped members 304 and 306 is such that the members are snugly received within the space between walls 108 and 110 of flotation chambers 102 and 104. Such configuration serves to further stabilize the molded forward portion 100 and assure proper positioning of the propulsion assembly with respect to the remaining parts of the craft.

Element 306 defines a pair of holes 316 in which are journalled first and second main shaft members 318 and 320. Shafts 318 and 320 are interconnected by appropriate male and female members and support, at the junction, a main gear wheel 322. A pair of hand cranks 324 and 326 are disposed, respectively, on each end of the shaft assembly 318–320 to enable rotation of gear wheel 322 by the cranking movement of the operator's arms. Main gear 322 transmits rotary movement through an idler gear assembly 328 which is mounted on a shaft 300 extending between the arms of member 306 in a pair of holes 332. The output bevel gear of assembly 328 cooperates with a small bevelled gear 334 on the end of a propeller shaft 336 mounted in a bearing 338 extending from frame member 310. A propeller 340 is mounted on the opposite end of propeller shaft 336 whereby cranking movement of the propulsion assembly causes either forward or backward rotation of the propeller to move the craft through the water.

A hydrodynamically streamlined cover assembly 400 is attached underneath the front portion 100 to form a substantially contiguous streamlined hull. Cover 400 has appropriate slots formed for receiving propeller shaft 336 as well as the main crank shaft 318–320 so that the cover may be removed without removing any other pieces of the assembly. Preferably, a plurality of L-shaped arms 130 are molded to protrude from bottom walls 112 and 114 of the front portion 100 adjacent the outer periphery thereof for interlocking cooperation with a peripheral flange 402 continuing about the upper periphery of the cover 400. A plurality of slots 404 in flange 402 accommodate the L-shaped protrusions 130 such that the cover may be slipped into place and then moved slightly toward the front of the craft to lock the cover into place as shown in detail in FIG. 8.

In operation, forward and rear portions 100 and 200 are first joined together by a tongue 202 in a selected position to establish the desired overall length of the craft to accommodate the height of the operator. The operator may then lie atop the craft with his feet in position on pedals 222 and his hands in position for manipulation of crank assemblies 324 and 326. In this manner, the craft may be propelled easily through the water, the swept-wing, buoyant float chamber of rear portion 200 cooperating with the high draft hull configuration of front portion 100 and cover 400 to provide extreme stability in operation and prevent rocking movement during cranking.

For storage, or for repair, front and rear portions 100 and 200 may be easily disassembled by removing wing nuts 208. Likewise, the entire propulsion unit 300 may be simply removed by removing the wing nuts of fasteners 302. In this manner, any damage which might occur during normal operation may be easily corrected and only individual portions of the craft need be replaced in the event of a mechanical breakdown.

Inasmuch as the present invention is subject to many variations, modifications and changes in detail, it is intended that all matter contained in the foregoing description or shown in the accompanying drawing shall be interpreted as illustrative and not in a limiting sense.

I claim:

1. A water craft comprising:

a front hull including at least one flotation chamber;

a rear stabilization deck assembly joined to and extending as a cantilever rearwardly of said hull, said stabilization deck comprising a hollow substantially flat flotation chamber;

foot controlled rudder means pivotally mounted on said rear deck assembly; and propulsion means on said hull and including a frame, a hand crank transversely mounted on said frame, a propeller assembly mounted on said frame, and means on said frame coupling rotary movement of said crank to said propeller assembly, said hull, said rear deck assembly, and said propulsion means each comprising discrete disconnectable modules; said rear stabilization deck including an elongated tongue; and said front hull including an elongated channel, said tongue being received in said channel and being longitudinally adjustable to establish the overall length of the craft.

2. A water craft according to claim 1 wherein said front hull includes two separate parallel flotation chambers joined together to form an apex.

3. A water craft according to claim 1 wherein said rear stabilization deck includes first and second pontoons mounted, respectively, on each side of said deck.

4. A water craft according to claim 1 wherein said frame of said propulsion means comprises first and second inverted, generally U-shaped frame members interconnected by a plurality of elongated frame elements to form a generally rectangular assembly.

5. A water craft according to claim 4 wherein said front hull comprises two parallel, spaced flotation chambers, and wherein a portion of each of said first and second U-shaped frame members is snugly received between said flotation chambers.

6. A water craft according to claim 1 further including a cover assembly for said propulsion means, said cover assembly being releasably secured to said front hull and cooperating therewith to provide a hydrodynamically streamlined hull assembly.

* * * * *